US009038533B2

(12) United States Patent
Demand

(10) Patent No.: US 9,038,533 B2
(45) Date of Patent: May 26, 2015

(54) INDUCTIVELY HEATABLE CYLINDER

(75) Inventor: Thomas Demand, Wetzlar (DE)

(73) Assignee: Gallus Druckmaschinen AG, Langgoens-Oberkleen (DE)

( * ) Notice: Subject to any disclaimer, the term of this patent is extended or adjusted under 35 U.S.C. 154(b) by 338 days.

(21) Appl. No.: 13/557,608

(22) Filed: Jul. 25, 2012

(65) Prior Publication Data

US 2013/0025478 A1 Jan. 31, 2013

(30) Foreign Application Priority Data

Jul. 27, 2011 (DE) ..... 10 2011 108 665

(51) Int. Cl.
*B44B 5/02* (2006.01)
*B41F 19/06* (2006.01)

(52) U.S. Cl.
CPC ..... *B44B 5/028* (2013.01); *B41F 19/062* (2013.01); *B41P 2219/31* (2013.01)

(58) Field of Classification Search
CPC .... B44B 5/028; B41F 19/062; B41P 2219/31
USPC ..... 101/3.1, 4, 5, 6, 8, 9, 21, 22, 23, 25, 27, 101/28, 31, 389.1; 492/8, 48, 49, 46
See application file for complete search history.

(56) References Cited

U.S. PATENT DOCUMENTS

| | | | | |
|---|---|---|---|---|
| 5,760,375 | A | 6/1998 | Hall | |
| 2005/0005787 | A1 | 1/2005 | Roos | |
| 2007/0042129 | A1 * | 2/2007 | Kang et al. | 427/510 |
| 2008/0299247 | A1 * | 12/2008 | Ogino et al. | 425/471 |

FOREIGN PATENT DOCUMENTS

| | | | |
|---|---|---|---|
| DE | 4401448 | B4 | 10/2004 |
| DE | 202008016510 | U1 | 3/2009 |
| DE | 102009020753 | A1 | 11/2010 |
| EP | 1425173 | B1 | 2/2008 |
| SU | 1108512 | A * | 8/1984 |
| WO | 2010124808 | A1 | 11/2010 |

* cited by examiner

*Primary Examiner* — Leslie J Evanisko
(74) *Attorney, Agent, or Firm* — Laurence A. Greenberg; Werner H. Stemer; Ralph E. Locher

(57) ABSTRACT

A device for heating at least one tool that is disposed on the circumference of a rotating cylinder, for example on the circumference of an embossing cylinder. The embossing tool is produced from a magnetizable material and it is fixed to a carrier sleeve that is produced from a non-magnetizable material.

6 Claims, 2 Drawing Sheets

INDUCTIVELY HEATABLE CYLINDER

CROSS-REFERENCE TO RELATED APPLICATION

This application claims the priority, under 35 U.S.C. §119, of German patent application DE 10 2011 108 665.3, filed Jul. 27, 2011; the prior application is herewith incorporated by reference in its entirety.

BACKGROUND OF THE INVENTION

Field of the Invention

The invention pertains to a device for heating at least one tool that is disposed on the periphery of a rotatable cylinder.

German patent DE 44 014 48 B4 describes the provision of an induction heating coil structure in the interior of a cylinder. The induction heater heats the entire circumferential surface of the cylinder and its flange.

German utility model DE 20 2008 016 510 U1 describes arranging a plurality of induction heaters distributed on the circumference of the shell of a roll, in order to be able to achieve regional heating of sections of the shell.

SUMMARY OF THE INVENTION

Against this background, it is an object of the invention to provide an induction heated cylinder which overcomes various disadvantages of the heretofore-known devices and methods of this general type and which provides for a tool-bearing cylinder which has a device for heating the tool.

With the foregoing and other objects in view there is provided, in accordance with the invention, a rotatable cylinder, comprising:

- a cylinder body formed with a cylinder shell having a periphery;
- an induction coil configured to generate a magnetic field; and
- a sleeve-shaped carrier body configured to be pushed onto the cylinder shell, and at least one tool disposed on or in said carrier body.

It is a particular advantage of the invention that it is substantially only the tools which are heated, whereas the remaining cylinder structure is unheated. As a result of this measure, a cooling time which must be adhered to in order to change the tools can be shortened substantially.

In addition, the warm-up time for the tools is minimized, since only low masses have to be heated.

In accordance with an added feature of the invention, the rotatable cylinder is an embossing cylinder for embossing a printing material. The printing material may be paper or plastic.

In accordance with an added feature of the invention, the at least one tool is formed of magnetizable material. The cylinder shell and the sleeve-shaped carrier body, on the other hand, are formed of a non-magnetizable material. In addition, the cylinder body may be formed of a non-magnetizable material.

It is a particular advantage of the invention that it is substantially only the tools which are heated, whereas the remaining cylinder structure is unheated. As a result of this measure, a cooling time which has to be complied with in order to change the tools can be shortened substantially.

In addition, the warm-up time and energy consumption for the tools is minimized, since only low masses have to be heated.

In an advantageous refinement, a single heater in the form of an induction coil is provided, the windings of which are laid around the circumferential surface of the cylinder.

A further advantage results from the lightweight structure of the cylinder body or of a sleeve-shaped carrier body arranged on the cylinder body, what is known as a "sleeve", made of a non-magnetizable material, such as aluminum. This measure leads to a considerable weight reduction.

With the above and other objects in view there is also provided, in accordance with the invention, a rotatable cylinder that comprises the following: a cylinder body formed with a cylinder shell having a periphery; an induction coil configured to generate a magnetic field effective radially outside said cylinder shell; and a sleeve-shaped carrier body carrying one or a plurality of tools radially outside said cylinder shell, said carrier body being formed of non-magnetizable material and said one or more tools being formed of magnetizable material, so that the magnetic field generated by said induction coil selectively heats said one or more tools while said carrier body is not heated by the magnetic field.

Other features which are considered as characteristic for the invention are set forth in the appended claims.

Although the invention is illustrated and described herein as embodied in an inductively heatable cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
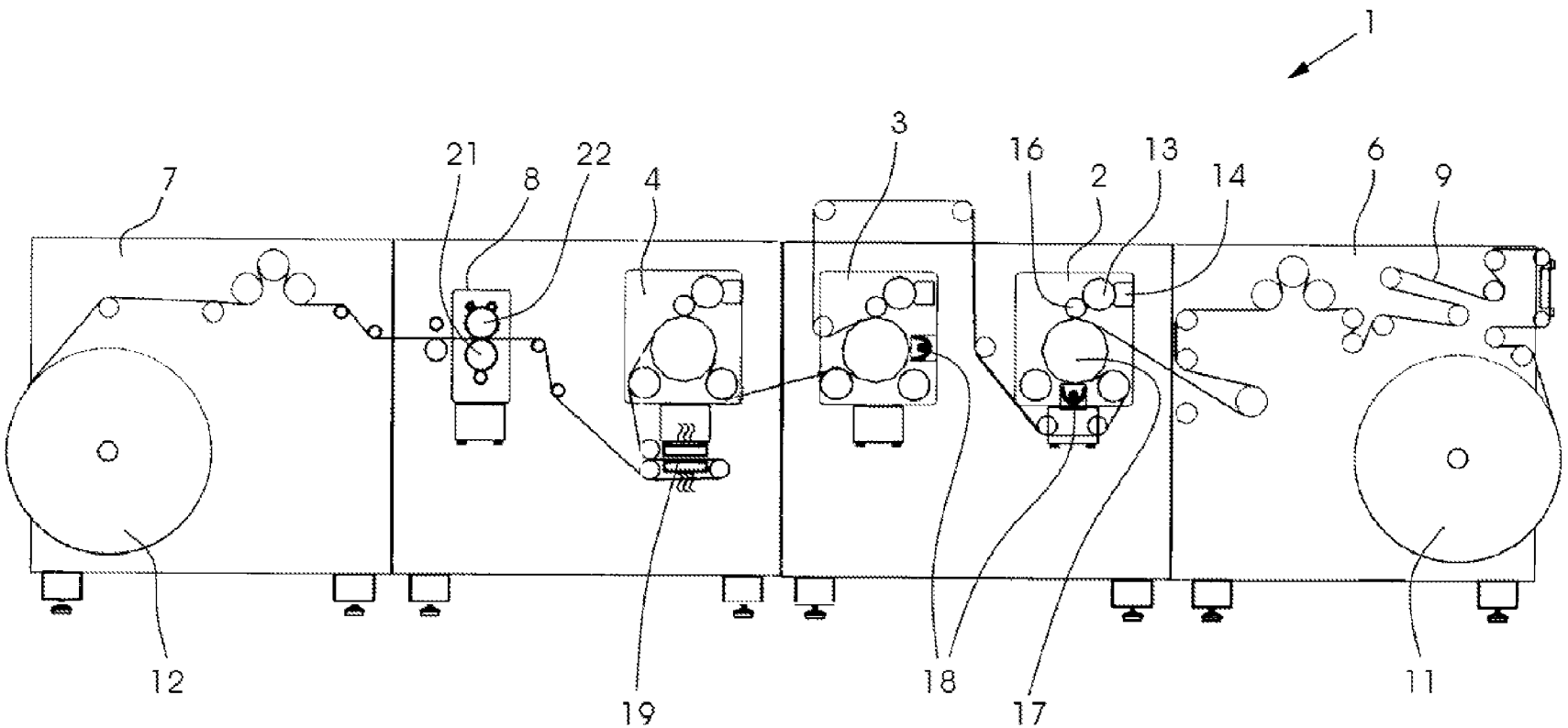
FIG. 1 is a schematic sectional side view of a web-fed rotary press with an embossing unit.
Figure 2:
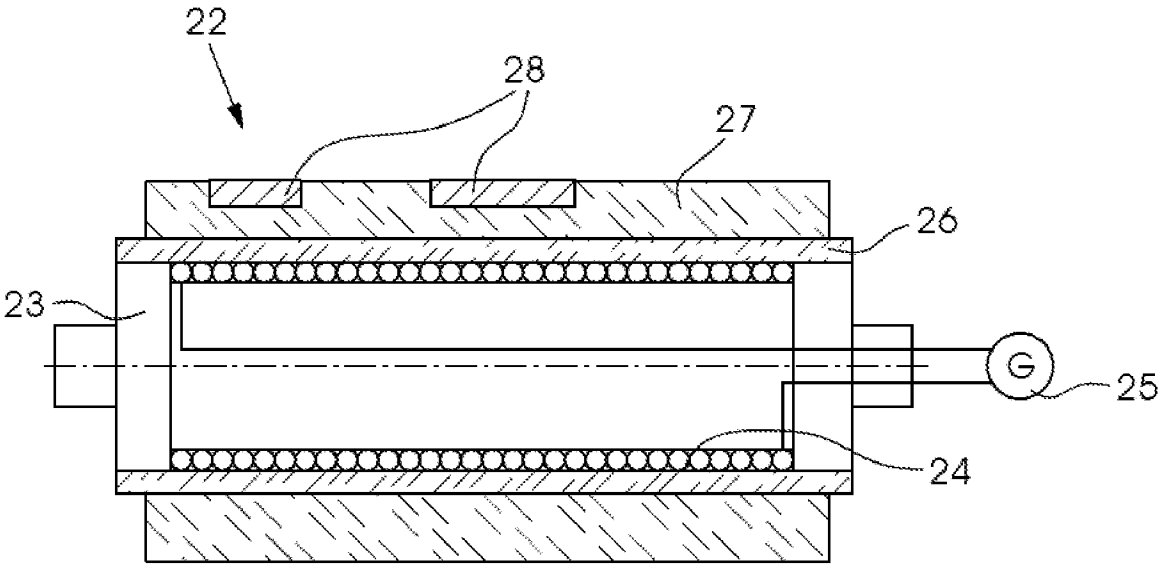
FIG. 2 is a schematic illustration of a longitudinal section taken through a cylinder according to the invention, the cylinder belonging to the embossing unit of the rotary press and carrying an induction-heated tool.

Referring now to the figures of the drawing in detail and first, particularly, to FIG. 1 thereof, there is shown a press 1. In the illustrated example, the press 1 is a label press, of in-line design, having printing units 2, 3, 4 following one another in the horizontal direction. The press further includes a roll feeder 6 and a roll delivery 7. Following the last printing unit 4 there is disposed an embossing unit 8, which is used to emboss the labels. The label press is used substantially for processing a substrate 9 in web form. The substrate 9 is unrolled from a substrate roll 11 in the roll feeder 6 and guided along a path through the press 1. Here, the substrate web 9 is printed, dried, embossed, etc. and ultimately rolled up onto a label roll 12 in the roll delivery 7.

The printing unit 2 is constructed as a so-called flexographic printing unit. In addition to an ink applicator roll 13 with chamber-type doctor 14, the printing unit 2 has a printing form cylinder 16 and an impression cylinder 17. A UV dryer 18 is disposed underneath the impression cylinder 17.

The printing unit 3 is likewise constructed as a flexographic printing unit, with a UV dryer 18 disposed laterally to the side of the impression cylinder 17.

The printing unit 4 shows a flexographic printing unit with a hot-air dryer 19 arranged underneath the impression cylinder 17.

The embossing unit 8 has two interacting cylinders 21, 22. The substrate web 9 is guided through a pressure nip formed by the two cylinders. A lower cylinder 21 serves as an impression cylinder for an upper embossing cylinder 22. The embossing cylinder 22 has a cylinder body 23 which is fabricated from a non-magnetizable material, for example aluminum, a ceramic composite material or a cubic face-centered steel.

An induction coil 24 is arranged on the cylinder circumference in such a way that the coil winding is wound over the circumference of the cylinder. The coil winding is connected to a current generator 25.

The embossing cylinder 22 bears a cylinder shell 26 in the form of a sleeve, which covers the induction coil 24. The cylinder shell 26 is produced from a non-magnetizable material.

A further sleeve, namely, a "tool sleeve" 27 can be pushed laterally onto the cylinder shell 26. The tool sleeve 27 is produced from a non-magnetizable material, for example aluminum, ceramic composite material or plastic, etc. The sleeve is a carrier body 27 for embossing tools 28. The embossing tools are produced from magnetizable material, for example cubic body-centered steel.

When the induction coil 24 is energized, by way of feeding current from the current supply 25 (e.g., a current generator G), a magnetic field is generated. This leads to the heating of the magnetizable materials that are located in the magnetic field of the coil. In the exemplary embodiment, these are the embossing tools 28. Since all the further cylinder components are produced from non-magnetizable materials they are not heated by the magnetic field generated in the process.

The following is a list of reference numerals used in the drawings and the above description:

1 Press (web-fed label press)
2 Printing unit
3 Printing unit
4 Printing unit
6 Roll feeder
7 Roll delivery
8 Embossing unit
9 Substrate web
11 Substrate roll
12 Label roll
13 Ink applicator roll
14 Chamber-type doctor
16 Printing form cylinder
17 Impression cylinder
18 UV dryer
19 Hot-air dryer
21 Cylinder (impression cylinder)
22 Embossing cylinder
23 Cylinder body (22)
24 Induction coil
25 Current generator
26 Cylinder shell (22)
27 Tool sleeve (carrier body)
28 Embossing tool

The invention claimed is:

1. A rotatable cylinder, comprising:
a cylinder body formed with a cylinder shell having a periphery;
an induction coil configured to generate a magnetic field; and
a sleeve-shaped carrier body configured to be pushed onto said cylinder shell, and at least one tool disposed on or in said carrier body;
said at least one tool being formed of magnetizable material, said cylinder shell, said cylinder body, and said sleeve-shaped carrier body being formed of a non-magnetizable material;
said induction coil for heating said at least one tool by generating a magnetic field from current fed to said induction coil.

2. The device according to claim 1, wherein the rotatable cylinder is an embossing cylinder for embossing a printing material.

3. The device according to claim 2, wherein the printing material is selected from the group consisting of paper and plastic.

4. The device according to claim 1, wherein said induction coil has windings wound around a circumference of said cylinder body.

5. The device according to claim 4, wherein said cylinder shell is formed to cover said windings of said induction coil.

6. A rotatable cylinder, comprising:
a cylinder body formed with a cylinder shell having a periphery;
an induction coil configured to generate a magnetic field effective radially outside said cylinder shell; and
a sleeve-shaped carrier body carrying one or a plurality of tools radially outside said cylinder shell, said cylinder shell, said cylinder body, and said carrier body being formed of non-magnetizable material and said one or more tools being formed of magnetizable material, so that the magnetic field generated by said induction coil selectively heats said one or more tools while said carrier body is not heated by the magnetic field.

* * * * *